United States Patent [19]

Feder

[11] 4,063,079

[45] Dec. 13, 1977

[54] LAMP ADAPTOR WITH FINIAL MOUNTING

[76] Inventor: Abe H. Feder, 15 W. 38 St., New York, N.Y.

[21] Appl. No.: 659,077

[22] Filed: Feb. 18, 1976

[51] Int. Cl.[2] ..... F21V 17/00

[52] U.S. Cl. ..... 362/290; 362/301

[58] Field of Search ..... 240/51.12, 52.1, 81 R, 240/126, 129, 153

[56] References Cited

U.S. PATENT DOCUMENTS

| | | | |
|---|---|---|---|
| 2,594,074 | 4/1952 | Rosenfeld | 240/81 R |
| 3,166,254 | 1/1965 | Goodman | 240/129 |
| 3,396,268 | 8/1968 | Cohon | 240/126 |
| 3,784,811 | 1/1974 | Feder | 240/81 LD |
| 3,878,390 | 4/1975 | Feder | 240/153 |

*Primary Examiner*—L. T. Hix
*Assistant Examiner*—William B. Perkey
*Attorney, Agent, or Firm*—David H. Semmes

[57] ABSTRACT

A lamp adaptor for use with a conventional electric lamp, such that enhanced indirect lighting capability is provided. The lamp adaptor includes a top baffle which directs the light upwardly and outwardly of the shade and simultaneously downwardly through the sides of the shade. The lamp adaptor has a threaded exterior male plug which is engageable with a conventional electric bulb socket in a table or floor lamp and includes a plurality of downwardly extending axial support struts which may engage a support collar encircling the conventional electric bulb socket. The lamp adaptor provides indirect as well as direct lighting capability in conventional electric lamps.

10 Claims, 5 Drawing Figures

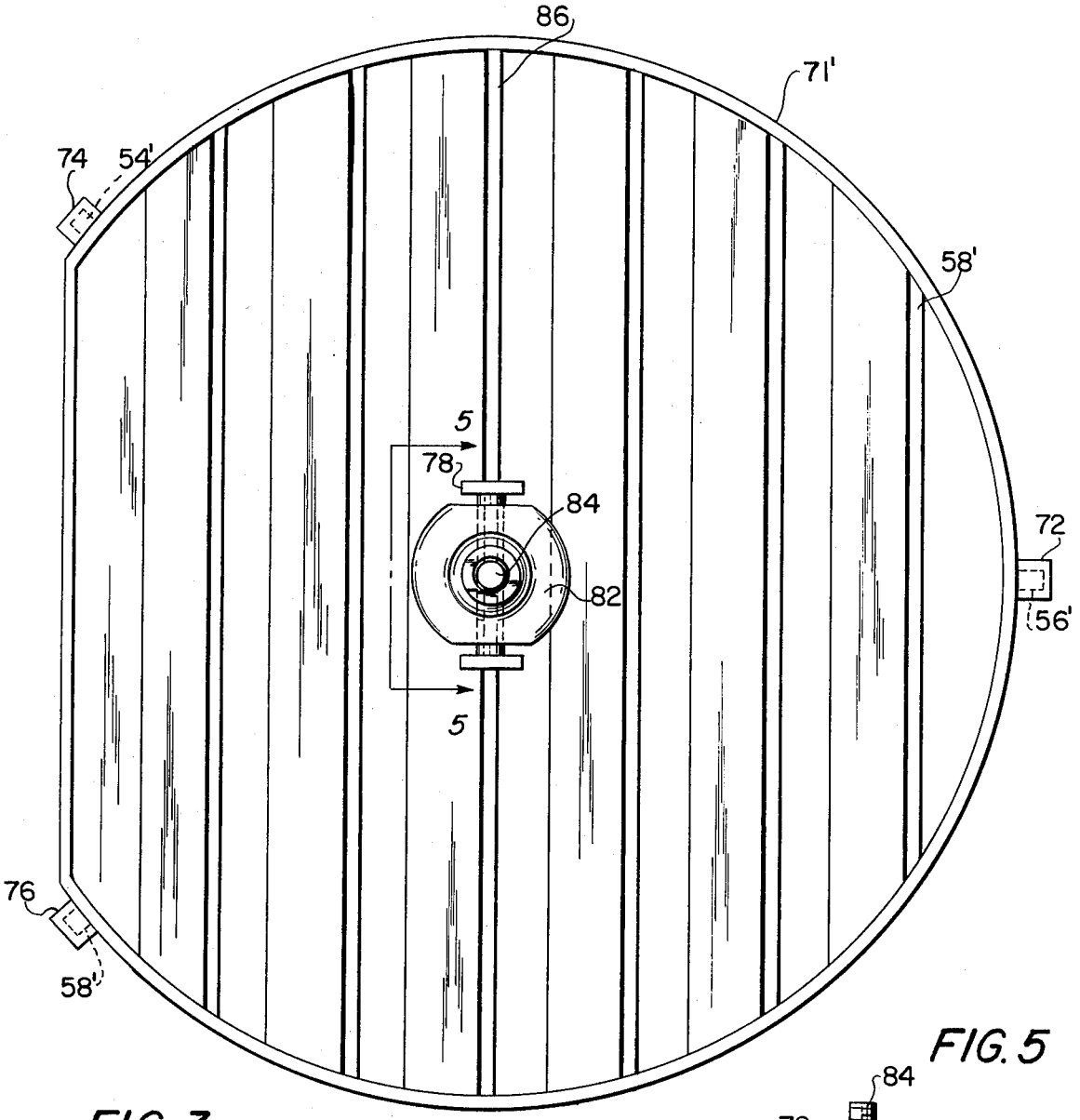
FIG. 3
FIG. 5
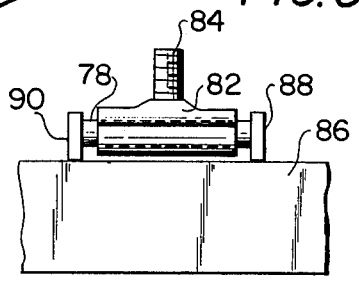
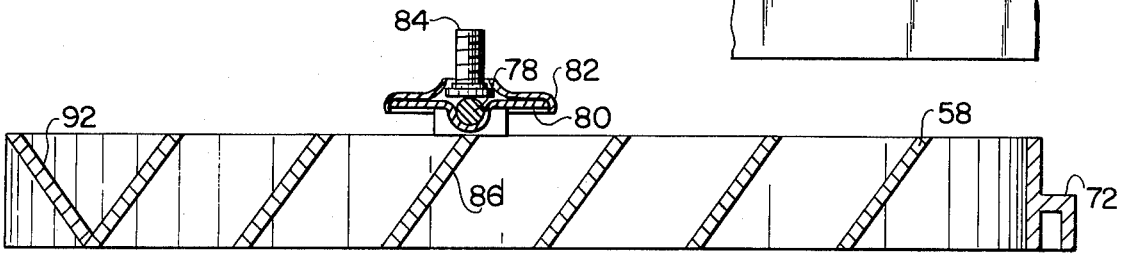
FIG. 4

LAMP ADAPTOR WITH FINIAL MOUNTING

CROSS-REFERENCES TO RELATED APPLICATIONS

The present application is an improvement upon applicant's LAMP ADAPTOR (U.S. Pat. No. 3,878,390), providing increased stabilization and support intermediate the conventional electric bulb socket and the adaptor.

BACKGROUND OF THE INVENTION

Indirect lighting lamps. A great deal of earlier attention has been given to lighting fixtures which provide both direct and indirect illumination. These fixtures for the most part have embodied elaborate electrical fitting and switching elements. Thus, the lamps have been costly to manufacture and of considerable bulk precluding their portability.

DESCRIPTION OF THE PRIOR ART

In Feder U.S. Pat. No. 3,784,811 indirect and direct lighting capability was provided by the combination of an especial baffle and a bracket supporting a reflector lamp and a pair of electric light bulbs. The unit was essentially custom made and required fitting to a special lamp having three-way switching for the separate reflector lamp and electric light bulb units.

In U.S. Pat. No. 3,878,390 the lamp adaptor includes an exterior male plug extending from the base so as to be engageable with a conventional electric lamp socket. The present invention includes the exterior male plug, in combination with a special support base and a pair of downwardly extending struts which engage a support collar encircling the conventional electric lamp socket.

SUMMARY OF THE INVENTION

According to the present invention, the lamp adaptor with finial mounting includes a base having at least one base socket for support of an electric light bulb fixture which may be of the reflector type. There is an exteriorally extending threaded male plug which interconnects the electric bulb fixture and a conventional female electric socket. The lamp adaptor includes a special mounting base having a plurality of downwardly extending support struts which may engage a support collar encircling the conventional electric lamp socket, so as to provide enhanced rigid support of the lamp adaptor with respect to the conventional lamp socket. A baffle may be supported above the base, so as to direct light selectively and a threaded lamp shade finial may be affixed to the top of the baffle.

BRIEF DESCRIPTION OF THE DRAWINGS

FIG. 3 is a top plan of a modified baffle;

FIG. 4 is a vertical section thereof; and

FIG. 5 is a fragmentary elevation of the finial mounting.

DESCRIPTION OF THE PREFERRED EMBODIMENTS

Figure 1:
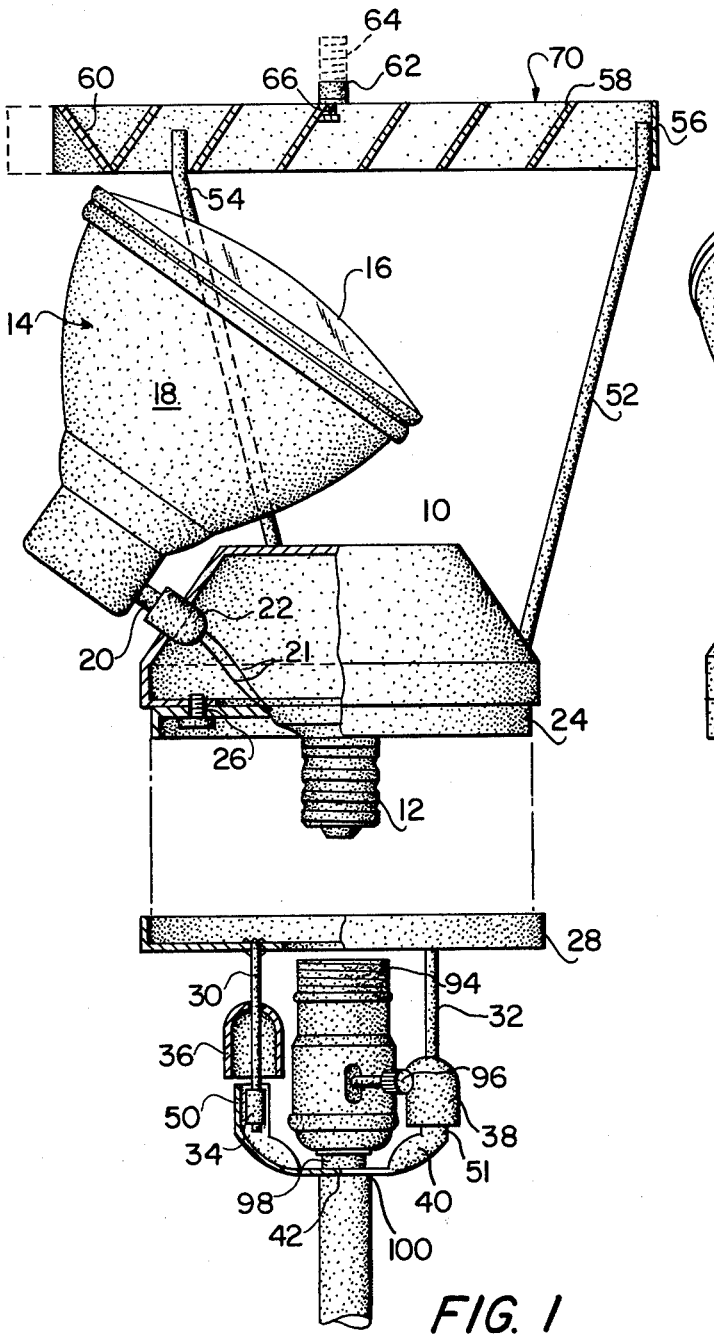
FIG. 1 is an exploded elevation, partially in section, showing the positioning of the lamp adaptor and support base with respect to a conventional female electric lamp socket.

In FIG. 1 the lamp adaptor is illustrated as including a truncated base housing 10 supporting a conventional and downwardly extending exterior male plug 12 which may threadedly engage conventional electric lamp female socket 94, having off-on switch 96. A reflector lamp 14 may include a plurality of prongs 20 which engage base socket 22 fitted in base housing 10. Suitable insulated, electric means 21 may interconnect base socket 22 and exterior male plug 12.

Lamp 14 may be of the reflector one-piece lamp type as manufactured by North American Phillips with a magnifying surface 16 and a silver-gold reflecting surface 18.

Lamp housing 10 may include a reduced diameter base support section 24 secured at its top to the bottom of the housing 10 by set screws 26 or the like. A conplementary and concave base fitting 28 may be provided, so as to encompass base support 24. Base fitting 28 may include a pair of downwardly extending struts 30, 32 having at their bottom ends enlarged bosses 34 and 35, including, also, shiftable fitting collars 36 and 38.

The lamp socket 94 may be mounted upon a conventional elongated arm 98 having an encircling collar 40 which may rest upon an enlarged diameter annular shoulder 100. Collar 40 may have upturned ends 50, 51 defining elongated cavities for complemental engagement of the ends of struts 30, 32, and their respective bosses 34, 35. Ring covers 36, 38 may be supported loosely upon struts 30, 32, so as to encircle collar ends 50, 51 as a press fitted or a threaded engagement. As will be apparent, this fitting or locking is an auxiliary support for the threaded interconnection of plug 12 and socket 94.

The baffle 70 may include a circular frame 71 supported upon a plurality of struts 54, 56 or the like and individual louver elements 58 which direct the light upwardly of the lamp shade. Louver element 60 may be provided for directing the light downwardly through the sides of a conventional shade (not illustrated).

As illustrated in FIG. 1 a median baffle may be employed to support a mounting base 66, cup 62 and threaded finial elements 64. Finial element 64 is not necessarily threaded and may be of the press fitted type.

Figure 2:
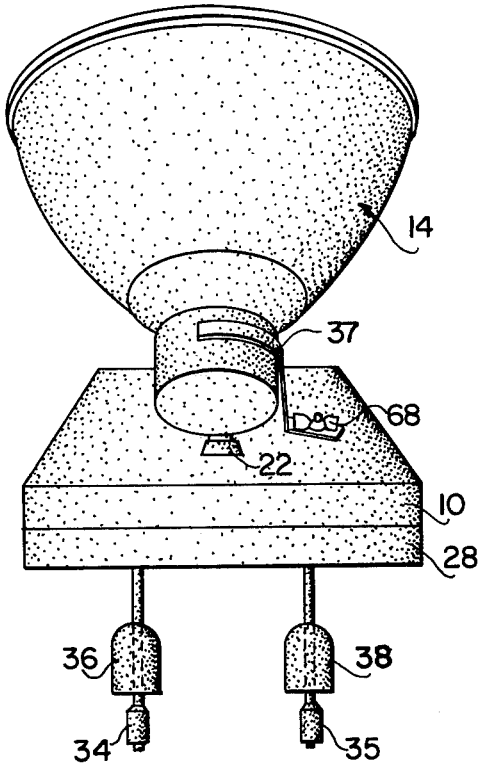
FIG. 2 is a rear elevation showing the lamp adaptor and support base adjoined prior to engagement with the conventional threaded lamp socket.

In FIG. 2 there is illustrated a resilient spring clip 37, anchored by means of wing nut 68 or the like, so as to supportingly engage the electric lighting fixture 14.

A modified baffle is illustrated in FIGS. 3–5, wherein the median baffle 86 includes lugs 88, 90 supporting transverse rod 78 upon which an upper cover 82 and bottom support 80 are fitted together for supporting threaded finial element 84. In this modification the various vertical struts e.g., 52, 54 and 56 may be seated in peripheral pockets 72, 74, 76 defined in the baffle exterior.

Manifestly, the baffle, as well as the base and support elements may be modified without departing from the spirit of the invention.

I claim:

1. A lamp adaptor with finial support comprising:

A. a base including at least one base socket for support of an electric bulb fixture, together with an electrical connection extending from said socket;

B. an exterior male plug contacting said electrical connection and extending from said base, so as to be engageable with an electric lamp socket;

C. at least one electrical lighting fixture supported in said base socket;

D. a baffle supported above said base, so as to direct selectively light from said electric lighting fixture with respect to said base; and E. a base support engageable at its top with the bottom of said base and including at least one strut member extending downwardly, so as to be engageable with an electrical lamp socket support;

all in combination with a threaded electric light bulb socket into which said exterior male plug is fitted, said socket being mounted upon an elongated arm and having a collar encircling said arm, so as to be engageable with said strut member extending downwardly so as to be engageable with an electric lamp socket support.

2. A lamp adaptor with finial support as in claim 1, said base support including two downwardly extending struts complementally engageable with corresponding apertures formed in the upturned ends of said collar.

3. A lamp adaptor as in claim 2, said struts including boss members at their downward ends engageable interiorally with the apertures formed in said collar.

4. A lamp adaptor as in claim 3, said downwardly extending struts including axially slidable ring covers exteriorally engaging the upturned ends of said collar.

5. A lamp adaptor as in claim 4, said collar upturned ends and the interior of said ring covers being complementally threaded.

6. A lamp adaptor as in claim 4, said engaging of said collar upturned ends and said ring covers being a press fit.

7. A lamp adaptor as in claim 4, a slidable ring cover encircling each said strut and engaging the exterior of said collar.

8. A lamp adaptor as in claim 1, said baffle further including:

A. a plurality of support strut members, extending upwardly from said base;

B. a peripheral frame secured to said support members;

C. a plurality of selectively directed baffles extending transversely over said frame; and D. a lamp shade finial mounting secured to a median baffle and extending upwardly thereof.

9. A lamp adaptor as in claim 1, including a resilient clip attached to said base, so as to supportingly engage said electric lighting fixture attached to said base socket.

10. A lamp adaptor with finial mounting as in claim 1, said threaded electric light bulb socket extended arm, including an annular diameter shoulder supporting an encircling collar, in supporting engagement with said base support.

* * * * *